US005925485A

United States Patent [19]

Patel et al.

[11] Patent Number: 5,925,485

[45] Date of Patent: Jul. 20, 1999

[54] METHOD OF MANUFACTURING A PHOSPHOR SCREEN FOR A CRT

[75] Inventors: Himanshu Mukundray Patel, Escondido, Calif.; Jeffrey Herbert Harrell, Marion, Ind.

[73] Assignee: Thomson Consumer Electronics, Inc., Indianapolis, Ind.

[21] Appl. No.: 09/129,236

[22] Filed: Aug. 5, 1998

[51] Int. Cl.[6] ..... G03C 5/00; G03G 13/20

[52] U.S. Cl. ..... 430/29; 430/31

[58] Field of Search ..... 430/23, 28, 31

[56] References Cited

U.S. PATENT DOCUMENTS

| | | | |
|---|---|---|---|
| 3,558,310 | 1/1971 | Mayaud | 430/25 |
| 4,917,978 | 4/1990 | Ritt et al. | 430/23 |
| 5,083,959 | 1/1992 | Datta et al. | 430/23 |
| 5,370,952 | 12/1994 | Datta et al. | 430/28 |
| 5,474,866 | 12/1995 | Ritt et al. | 430/23 |

*Primary Examiner*—Roland Martin
*Attorney, Agent, or Firm*—Joseph S. Tripoli; Dennis H. Irlbeck

[57] ABSTRACT

In accordance with the present invention, shown in FIG. 3, a method of electrophotographically manufacturing a phosphor screen, comprises the steps of coating 44 an interior surface of a viewing faceplate panel to form a volatilizable organic conductive (OC) layer and overcoating 46 the OC layer to form a volatilizable organic photoconductive (OPC) layer. The OPC layer is electrostatically charged 48 and selected areas of the OPC layer are exposed to light to form a charge image 50. The charge image is developed with at least one phosphor material 52 which is fixed 58 to the OPC layer by spraying a fixing solution comprising two solvents, having substantially different rates of evaporation onto the phosphor material on the OPC layer to affect the solubility thereof and to make the OPC layer tacky. At least a portion or all of the solvent with the higher rate of evaporation is allowed to evaporate while the solvent with the lower rate of evaporation retains the tackiness of the OPC layer. The phosphor material on the OPC layer is resprayed with the fixing solution comprising the two solvents having the substantially different rates of evaporation to uniformly fix the phosphor material to said OPC layer. Then, the fixed phosphor material is filmed 62 and an aluminum layer is deposited thereon 66 to form the screen assembly which is baked at an elevated temperature to drive off the volatilizable constituents thereof.

4 Claims, 3 Drawing Sheets

Fig. 1
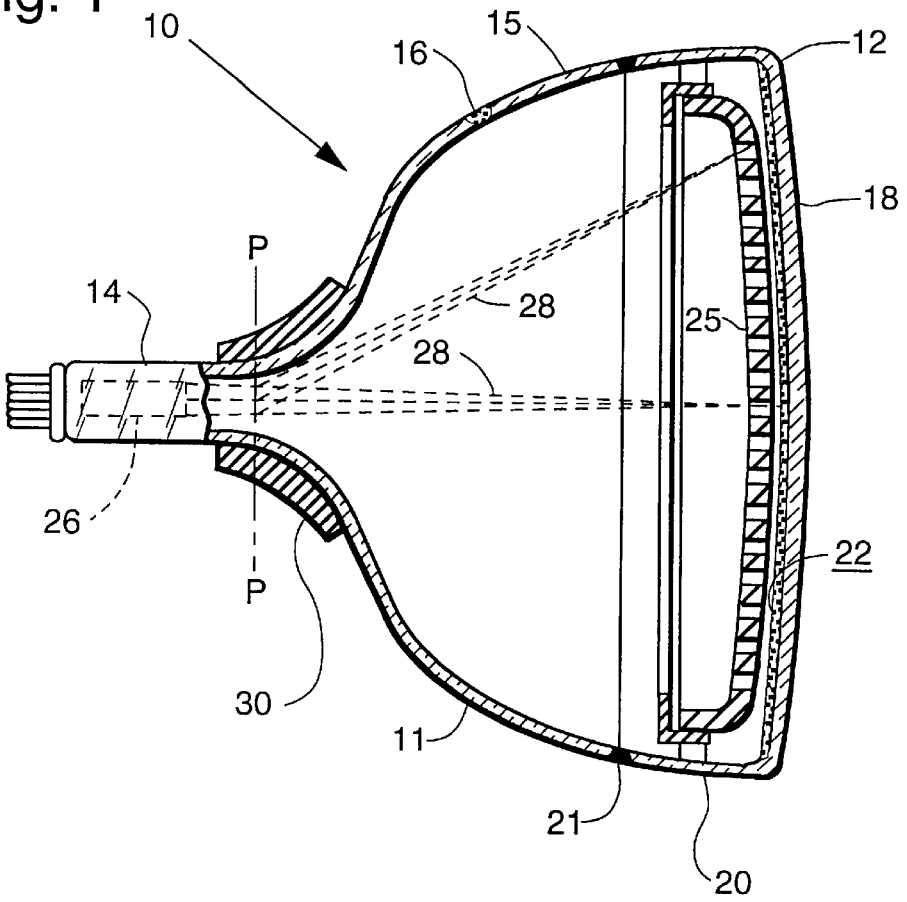
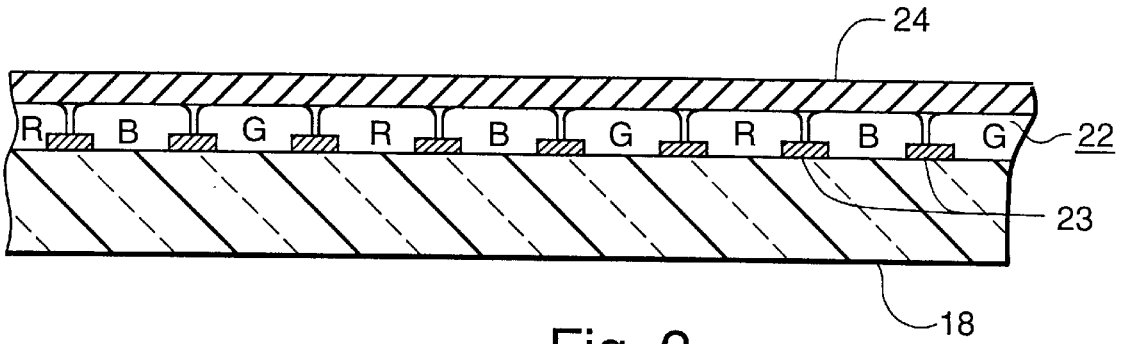
Fig. 2

METHOD OF MANUFACTURING A PHOSPHOR SCREEN FOR A CRT

The present invention relates to a method of electrophotographically manufacturing a phosphor screen for a cathode-ray tube (CRT), and more particularly to an improved fixing process.

BACKGROUND OF THE INVENTION

U.S. Pat. No. 4,917,978, issued on Apr. 17, 1990, to Ritt et al., describes a method of manufacturing a screen assembly for a CRT by the electrophotographic screening (EPS) process. The method described in the aforementioned patent includes a "fusing" step followed by a "fixing" step to increase the adherence of the phosphor screen elements to an underlying organic photoconductive (OPC) layer deposited on the interior surface of the CRT faceplate panel. In the fusing step, vapors of a solvent are permitted to contact and soak the OPC layer and the polymeric coupling agent that coats the phosphor materials, to render the layer and the coating tacky. Vapor soaking takes on the order of 4 to 24 hours. The panels are then dried and "fixed" by spraying multiple layers of polyvinyl alcohol (PVA) in an alcohol-water mixture onto the fused phosphor elements. Each spray application requires about 2 to 5 minutes to achieve complete screen coverage. The "fixed" screens are then filmed, either by convention spray or emulsion filming. It has been determined that the PVA spray applications tend to move the phosphor elements slightly, which night be unacceptable, depending on the amount of movement.

U.S. Pat. No. 5,474,866, issued on Dec. 12, 1995 to Ritt et al., describes a method for fixing the phosphor elements to the underlying OPC layer, by electrostatically spraying a suitable fixative. The fixative dissolves the polystyrene of the OPC layer in such a manner that the phosphor elements are at least partially encapsulated by the OPC layer, without causing any movement of the phosphors. However, using the process of U.S. Pat. No. 5,474,866, it is very difficult to fix the screen uniformly across the panel surface on a consistent basis. The polystyrene of the OPC layer 34 is completely soluble in the fixatives amyl acetate, butyl acetate, MIBK, toluene and xylene, and partially soluble in acetone, the former all having a boiling point within the range of 100 to 150° C. MIBK has been the preferred fixative because it dissolves the polystyrene of the OPC layer 34 more slowly than the other solvents, and encapsulates the phosphor elements without moving them. However, screens fixed with MIBK contain under and over fixed areas within the same panel, thereby adversely affecting the subsequent film uniformity.

SUMMARY OF THE INVENTION

In accordance with the present invention, a method of electrophotographically manufacturing a phosphor screen, comprises the steps of coating an interior surface of a viewing faceplate panel to form a volatilizable organic conductive (OC) layer and overcoating the OC layer to form a volatilizable organic photoconductive (OPC) layer. The OPC layer is electrostatically charged and selected areas of the OPC layer are exposed to light to form a charge image. The charge image is developed with at least one phosphor material which is fixed to the OPC layer by spraying a fixing solution comprising two solvents, having substantially different rates of evaporation, onto the phosphor material on the OPC layer to affect the solubility thereof and to make the OPC layer tacky. At least a portion or all of the solvent with the higher rate of evaporation evaporates while the solvent with the lower rate of evaporation remains to retains the tackiness of the OPC layer. The phosphor material and the OPC layer are resprayed with the fixing solution to complete the uniform fixing of the phosphor material to the OPC layer. Then, the fixed phosphor material is filmed and an aluminum layer is deposited thereon to form the screen assembly, which is baked at an elevated temperature to drive off the volatilizable constituents thereof.

BRIEF DESCRIPTION OF THE DRAWING

In the drawings:

FIG. 1 is a plan view, partially in axial section, of a color CRT made according to the present invention;

FIG. 2 is a section of a faceplate panel of the CRT of FIG. 1, showing a phosphor screen assembly;

DETAILED DESCRIPTION OF THE PREFERRED EMBODIMENTS

Figure 3:
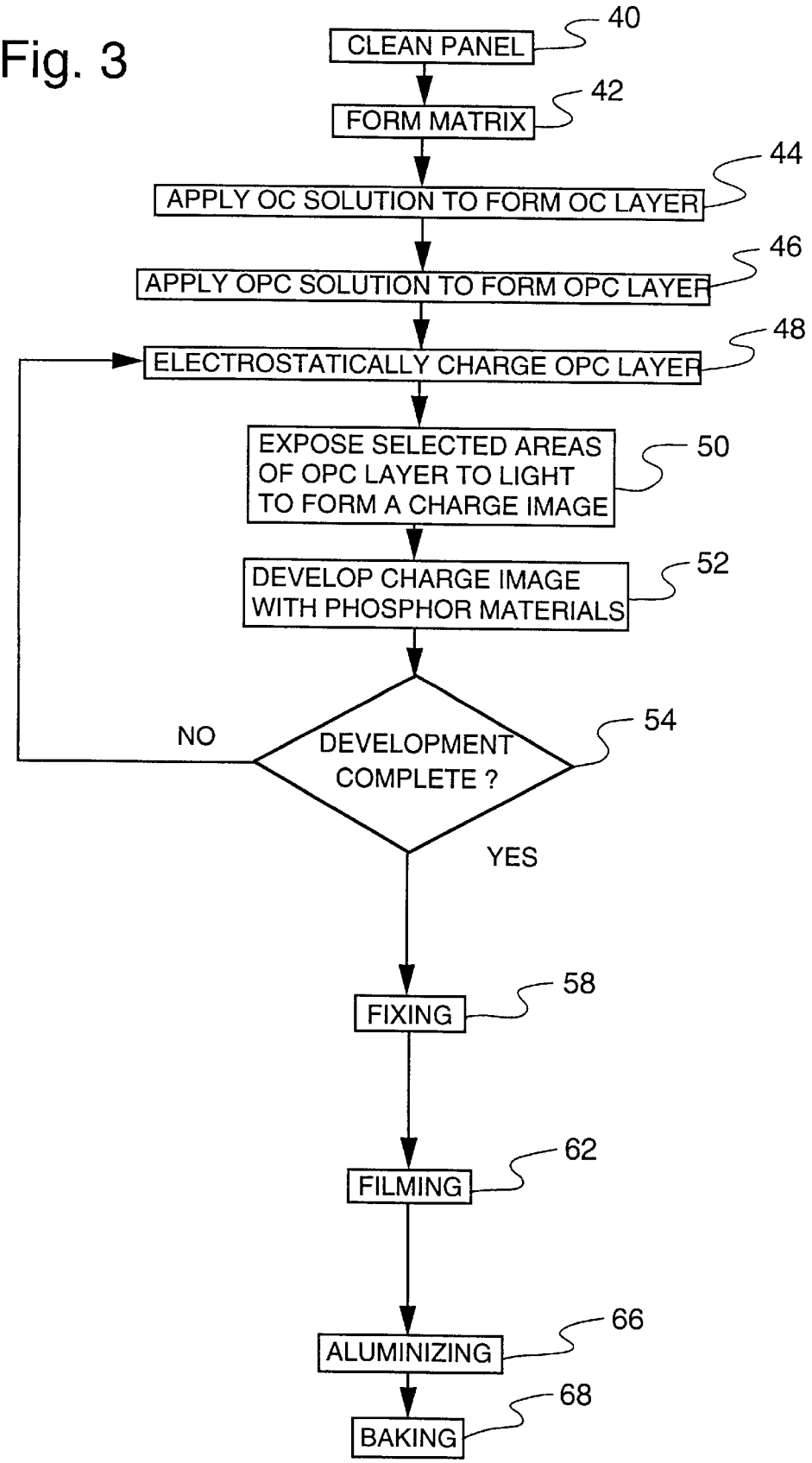
FIG. 3 is a block diagram comprising a flow chart of the manufacturing process involved.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A luminescent three color phosphor screen 22 is carried on the inner surface of the faceplate 18. The screen 22, shown in FIG. 2, is a line screen that includes a multiplicity of screen elements composed of red-emitting, green-emitting and blue-emitting phosphor stripes R, G, and B, respectively, arranged in color groups or picture elements of three stripes or triads, in a cyclic order. The stripes extend in a direction that is generally normal to the plane in which the electron beams are generated. In the normal viewing position, the phosphor stripes extend in a vertical direction. Preferably, at least portions of the phosphor stripes overlap a relatively thin, light absorptive matrix 23, as is known in the art. A dot screen also may be formed by the novel process. A thin conductive layer 24, preferably of aluminum, overlies the screen 22 and provides means for applying a uniform potential to the screen, as well as for reflecting light, emitted from the phosphor elements, through the faceplate 18. The screen 22 and the overlying aluminum layer 24 comprise a screen assembly. A multi-apertured color selection electrode or shadow mask 25 is removably mounted, by conventional means, in predetermined spaced relation to the screen assembly.

An electron gun 26, shown schematically by the dashed lines in FIG. 1, is centrally mounted within the neck 14, to generate and direct three electron beams 28 along convergent paths, through the apertures in the mask 25, to the screen 22. The electron gun is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields that cause the beams to scan horizontally and vertically, in a rectangular raster, over the screen 22. The initial plane of deflection (at zero deflection) is shown by the line P—P in FIG. 1, at about the middle of the yoke 30. For simplicity, the actual curvatures of the deflection beam paths, in the defection zone, are not shown.

The screen is manufactured by an electrophotographic screening (EPS) process that is shown schematically in FIG. 3. Initially, the panel 12 is cleaned, as indicated by reference numeral 40, by washing it with a caustic solution, rinsing it in water, etching it with buffered hydrofluoric acid and rinsing it again with water, as is known in the art. The interior surface of the viewing faceplate 18 is then provided with the light absorbing matrix 23, as indicated by reference numeral 42, preferably, using the conventional wet matrix process described in U.S. Pat. No. 3,558,310, issued to Mayaud on Jan. 26, 1971. In the wet matrix process, a suitable photoresist solution is applied to the interior surface, e.g., by spin coating, and the solution is dried to form a photoresist layer. Then, the shadow mask is inserted into the panel and the panel is placed onto a three-in-one lighthouse that exposes the photoresist layer to actinic radiation from a light source that projects light through the openings in the shadow mask. The exposure is repeated two more times with the light source located to simulate the paths of the electron beams from the three electron guns. The light selectively alters the solubility of the exposed areas of the photoresist layer where phosphor materials will subsequently be deposited. After the third exposure, the panel is removed from the lighthouse and the shadow mask is removed from the panel. The photoresist layer is developed, using water, to remove the more soluble areas thereof, thereby exposing the underlying interior surface of the faceplate, and leaving the less soluble, exposed areas of the photoresist layer intact. Then, a suitable solution of light-absorbing material is uniformly provided onto the interior surface of the faceplate 18 to cover the exposed portion of the faceplate and the retained, less soluble, areas of the photoresist layer. The layer of light-absorbing material is dried and developed using a suitable solution that will dissolve and remove the retained portion of the photoresist layer and the overlying light-absorbing material, forming windows in the matrix layer that is adhered to the interior surface of the faceplate.

Figure 4:
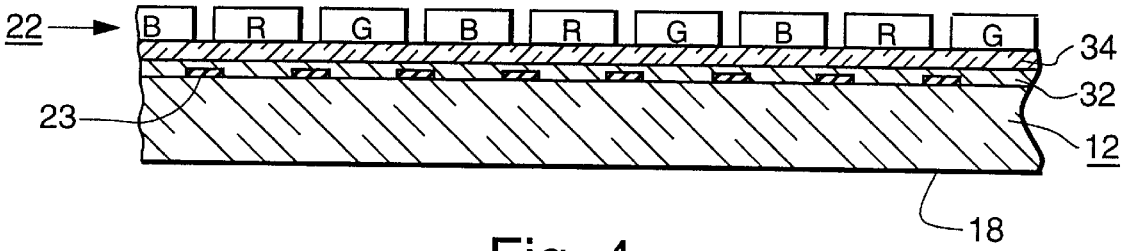
FIG. 4 shows a step in the manufacturing process in which a multiplicity of color-emitting phosphor screen elements are deposited onto an OPC layer.

The interior surface of the faceplate 18, having the matrix 23 thereon, is then coated with a suitable solution of a volatilizable, organic conductive (OC) material to form an OC layer 32, as indicated by reference numeral 44, that provides an electrode for an overlying volatilizable, organic photoconductive (OPC) layer 34. The OC layer 32 and the OPC layer 34 are shown in FIG. 4.

Suitable materials for the OC layer 32 include certain quaternary ammonium polyelectrolytes recited in U.S. Pat. No. 5,370,952, issued to Datta et al. on Dec. 6, 1994. Preferably, the OPC layer 34 is formed, as indicated by reference numeral 46, by coating the OC layer 32 with an OPC solution containing polystyrene; an electron donor material, such as 1,4-di(2,4-methyl phenyl)-1,4 diphenylbutatriene; an electron acceptor materials, such as 2,4,7-trinitro-9-fluorenone and 2-ethylanthroquinone; and at least one solvent, such as toluene or xylene, or a combination thereof. A surfactant, such as silicone U-7602 and a plasticizer, such as dioctyl phthalate, also may be added to the OPC solution. The surfactant U-7602 is available from Union Carbide, Danbury Conn.

The OPC layer 34 is uniformly electrostatically charged, as indicated by reference numeral 48, using a corona discharge device, not shown, that is described in U.S. Pat. No. 5,083,959, issued on Jan. 28, 1992, to Datta et al. The OPC layer 34 is charged to a voltage within the range of approximately +200 to +700 volts. The shadow mask 25 is then inserted into the panel 12, which is placed onto a lighthouse, also not shown, and the positively charged OPC layer 34 is exposed, through the shadow mask 25, to light from a suitable light source disposed within the lighthouse. The light passes through the apertures in the shadow mask 25, at an angle identical to that of one of the electron beams from the electron gun of the tube, and discharges the illuminated areas on the OPC layer 34 on which it is incident to form a charge image, as indicated by reference numeral 50. The shadow mask is removed from the panel 12, and the panel is placed onto a first phosphor developer containing a first color-emitting phosphor material, to develop the charge image, as indicated by reference numeral 52. The first color-emitting phosphor material is positively triboelectrical charged within the developer and directed toward the OPC layer 34. The positively charged first color-emitting phosphor material is repelled by the positively charged areas on the OPC layer 34 and deposited onto the discharged areas thereof by the process known in the art as "reversal" development. In reversal development, triboelectrically charged particles of screen structure material are repelled by similarly charged areas of the OPC layer 34 and deposited onto the discharged areas thereof. The size of each of the lines of the first color-emitting phosphor elements is slightly larger than the size of the openings in the light-absorbing matrix to provide complete coverage of each opening, and a slight overlap of the light-absorbing matrix material surrounding the openings. Because a total of three different color-emitting phosphors are required to form the phosphor screen 22, the development, as indicated by reference numeral 54 is not complete. Accordingly, the panel 12 is electrostatically recharged, as indicated by reference numeral 48, using the above-described corona discharge apparatus. A positive voltage is established on the OPC layer 34 and on the first color-emitting phosphors material deposited thereon. The light exposure step 50 and the phosphor development step 52 are repeated for each of the two remaining color-emitting phosphors. The size of each of the lines of the other two color-emitting phosphor elements on the OPC layer 34 also is larger than the size of the matrix openings, to ensure that no gaps occur and that a slight overlap of the light-absorbing matrix material surrounding the openings is provided. The resultant phosphor screen 22 is shown in FIG. 4

Figure 5:
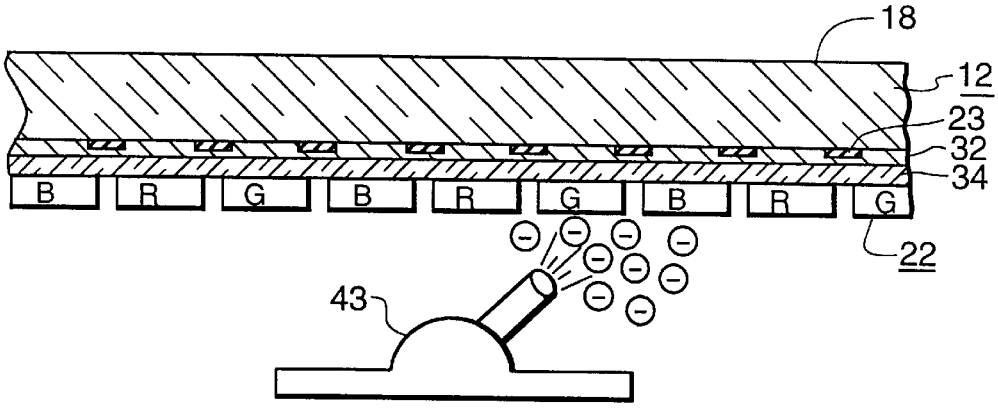
FIG. 5 shows a fixing step in the manufacturing process.

The three light-emitting phosphors are fixed to the above-described OPC layer 34 in a subsequent manufacturing step, as indicated in FIG. 3 by numeral 58. The phosphors elements are contacted with a suitable fixative that is electrostatically charged by an electrostatic spray gun 43, shown in FIG. 5. The preferred electrostatic spray gun is an AEROBELL™ model, available from ITW Ransburg, Toledo, Ohio. The electrostatic gun provides negatively charged droplets of uniform size that wet the phosphor screen elements and the underlying OPC layer 34, without moving the phosphors. As shown in FIG. 5, the panel 12 is oriented with the OPC layer 34 and the phosphor screen elements directed downwardly, toward the electrostatic gun 43. The downward orientation of the panel 12 prevents any large droplets, forming on the electrostatic gun 43, from dropping onto the screen 22 and moving the phosphor elements. As previously stated, using the prior art process, it was very difficult to fix the screen uniformly across the panel surface on a consistent basis. The polystyrene used in the OPC layer 34 is completely soluble in the preferred fixative, MIBK, because it dissolves the polystyrene of the OPC layer 34 more slowly than the other solvents, and encapsulates the phosphor elements without moving them. However, screens fixed with MIBK contain under and over fixed areas within the same panel, thereby adversely affecting the subsequent film uniformity. This is due to the single medium reactivity of polystyrene in the MIBK solvent and the relatively rapid evaporation rate of MIBK which has a boiling point of 117° C. and a vapor pressure of 15.7 mm Hg. The fixing is improved over the prior process by forming a mixture of solvents, more specifically, by adding a co-solvent, such as d-Limonene, which has a lower solvency strength and slower evaporation rate than MIBK. D-Limonene has a boiling point of 175° C. and a vapor pressure of 2 mm Hg. It has been found that by electrostatically spraying the aforementioned mixture, in a ratio of 2 parts MIBK to 1 part d-Limonene, the uniformity of the fixing is significantly improved. In the novel process, the mixture of solvents is electrostatically sprayed onto the phosphors and the OPC layer in two passes of the electrostatic spray guns. The passes include a forward pass and a backward pass, with a delay of 0 to 45 seconds between the first and second passes, although a delay of 30 seconds is preferred. It has been determined that the delay permits at least a portion, or in some instances, all of the MIBK from the first pass to evaporate. However, the OPC layer retains its tackiness because the d-Limonene evaporates more slowly and keeps the OPC layer wet and tacky until the second pass of the spray guns. The use of the mixed solvents, with different rates of evaporation, provide greater process latitude and better uniformity of encapsulation of the phosphor material to the OPC layer.

In the TABLE below the results of a fixing test are summarized. The ratio of MIBK to d-Limonene is 2:1, and the delay time between passes was varied from 0 to 45 seconds. The sweep time of the electrostatic guns was 4 seconds across the panel in each direction. Two electrostatic guns were used in the spray module. Gun #1 had a fluid flow of 12 ml./8 seconds and gun #2 had a fluid flow of 16 ml./8 seconds.

TABLE

| Delay Between Passes (Seconds) | Results |
|---|---|
| 0 | Overfixed areas observed w/ white light |
| 30 | adequate fixing |
| 45 | underfixed areas observed w/ UV |

The phosphor screen is then filmed, in yet another manufacturing step, as indicated in FIG. 3 by numeral 62, to provide a filming layer, not shown, that forms a smooth surface, which completely covers the phosphor elements of the screen 22. The aluminum layer 24 subsequently will be deposited onto the film layer. The film, preferably, is deposited by electrostatically spraying a polymeric solution over the phosphor screen elements. The preferred filming solution is an acrylic resin dissolved in MIBK. Good results have been obtained using a resin, available from Pierce and Stevens, Buffalo, N.Y., comprising about 90 wt. % of polymethyl methacrylate, 9 wt. % of isobutyl methacrylate, and the balance being the plasticizer DOP, and nitrocellulose. The resin solids comprise about 3 to 10 wt. % of the filming solution.

After filming, the phosphor screen 22 is aluminized, as indicated by reference numeral 66, to form a screen assembly, and baked, as indicated by reference numeral 68, at a temperature of about 425° C., for about 30 minutes, to remove the volatilizable constituents, such as the OC layer 32, the OPC layer 34 and the filming layer.

What is claimed is:

1. In a method of manufacturing a luminescent screen assembly for a CRT on an interior surface of a viewing faceplate panel comprising the steps of:

a) coating said interior surface of said viewing faceplate panel to form a volatilizable organic conductive (OC) layer;

b) overcoating said OC layer to form a volatilizable organic photoconductive (OPC) layer;

c) electrostatically charging said OPC layer;

d) exposing selected areas of said OPC layer to light to form a charge image;

e) developing said charge image with at least one phosphor material;

f) fixing phosphor material to said OPC layer;

g) filming said fixed phosphor material;

h) depositing an aluminum layer thereon to form said screen assembly; and i) baking said screen assembly at an elevated temperature to drive off the volatilizable constituents thereof; the improvement wherein step f) includes the substeps of:

j) spraying a first pass with a fixing solution comprising two solvents, having substantially different rates of evaporation onto said phosphor material on said OPC layer to affect the solubility of said OPC layer to make said layer tacky;

k) allowing at least a portion or all of the solvent with the higher rate of evaporation to evaporate while the solvent with the lower rate of evaporation retains the tackiness of said OPC layer; and l) spraying a second pass with said fixing solution comprising the two solvents having substantially different rates of evaporation onto said phosphor material on said OPC layer to uniformly fix said phosphor material to said OPC layer.

2. The method as described in claim 1, wherein the solvent with the higher evaporation rate is MIBK, having a boiling point of 117° C., and a vapor pressure of 15.6 mm Hg, and the solvent with the lower evaporation rate is d-Limonene, having a boiling point of 174° C., and a vapor pressure of 2 mm Hg.

3. The method as described in claim 1, wherein the time interval between the first and second spray passes is within the range of 0 to 45 seconds.

4. The method as described in claim 3, wherein the time interval between the first and second spray passes is about 30 seconds.

* * * * *